US012760609B1

(12) United States Patent
Clark et al.

(10) Patent No.: US 12,760,609 B1
(45) Date of Patent: Oct. 13, 2026

(54) DOWNHOLE TOOLS AND METHODS, AND IMPROVED SLIP ASSEMBLIES AND PROFILED SLIP ELEMENTS THEREFOR

(71) Applicant: Target Completions LLC, Broken Arrow, OK (US)

(72) Inventors: Joseph Clark, Lago Vista, TX (US); Michael Thomas Sommers, Broken Arrow, OK (US)

(73) Assignee: TARGET COMPLETIONS LLC, Broken Arrow, OK (US)

( * ) Notice: Subject to any disclaimer, the term of this patent is extended or adjusted under 35 U.S.C. 154(b) by 0 days.

(21) Appl. No.: 19/285,119

(22) Filed: Jul. 30, 2025

(51) Int. Cl.
*E21B 23/01* (2006.01)

(52) U.S. Cl.
CPC ..... *E21B 23/01* (2013.01)

(58) Field of Classification Search
CPC ..... E21B 23/01
See application file for complete search history.

(56) References Cited

U.S. PATENT DOCUMENTS 2,802,534 A 8/1957 Conrad
3,179,180 A 4/1965 Hart
3,189,096 A 6/1965 Phenix
3,664,417 A 5/1972 Conrad
4,077,472 A * 3/1978 Gano ..... E21B 33/043 166/359
4,317,485 A 3/1982 Ross
4,530,398 A 7/1985 Greenlee et al.
4,605,063 A 8/1986 Ross
4,765,403 A 8/1988 Crawford
5,131,468 A 7/1992 Lane et al.
5,148,866 A 9/1992 Greenlee
5,224,540 A * 7/1993 Streich ..... E21B 33/1293 166/134
5,327,975 A 7/1994 Land
5,366,019 A 11/1994 Brooks
5,390,737 A * 2/1995 Jacobi ..... E21B 29/00 166/134
5,771,969 A 6/1998 Garay
5,839,515 A * 11/1998 Yuan ..... E21B 33/1293 166/134
5,984,007 A * 11/1999 Yuan ..... E21B 33/1293 166/134
6,164,377 A * 12/2000 Roberts ..... E21B 7/06 166/125
6,167,963 B1 * 1/2001 McMahan ..... E21B 33/1216 166/134
6,305,474 B1 * 10/2001 Roberts ..... E21B 47/024 166/117.6
6,564,871 B1 * 5/2003 Roberts ..... E21B 47/024 166/134
9,677,356 B2 * 6/2017 Rochen ..... E21B 23/01
9,725,981 B2 * 8/2017 Young ..... E21B 23/0411
9,890,603 B2 2/2018 Moore
10,415,335 B2 * 9/2019 Mhaskar ..... E21B 33/129
(Continued)

*Primary Examiner* — Steven A MacDonald
(74) *Attorney, Agent, or Firm* — Dennis D. Brown; Brown Patent Law, P.L.L.C.

(57) ABSTRACT

A slip, a profiled slip insert, and an upper slip assembly for a downhole tool which are effective for running the downhole tool into a well with minimal biting or frictional resistance and are additionally effective for firmly gripping the I.D. of the well casing while also reducing the pulling force required for releasing the slips from the casing.

14 Claims, 6 Drawing Sheets

(56) References Cited

U.S. PATENT DOCUMENTS

| | | | | |
|---|---|---|---|---|
| 11,193,347 | B2 * | 12/2021 | Smith | E21B 23/01 |
| 12,031,411 | B1 * | 7/2024 | Clark | E21B 40/001 |
| 2002/0088616 | A1 * | 7/2002 | Swor | E21B 33/1292 166/387 |
| 2003/0155118 | A1 * | 8/2003 | Sonnier | E21B 29/10 166/212 |
| 2003/0188876 | A1 * | 10/2003 | Vick | E21B 33/1208 166/134 |
| 2005/0167097 | A1 | 8/2005 | Sommers et al. | |
| 2009/0321067 | A1 | 12/2009 | Kline et al. | |
| 2014/0020911 | A1 * | 1/2014 | Martinez | E21B 33/129 166/134 |
| 2014/0090831 | A1 * | 4/2014 | Young | E21B 23/0411 166/118 |
| 2015/0027737 | A1 * | 1/2015 | Rochen | E21B 23/01 166/138 |
| 2015/0368994 | A1 * | 12/2015 | Mhaskar | E21B 33/129 166/217 |
| 2017/0306711 | A1 * | 10/2017 | Hern | E21B 29/06 |
| 2019/0186229 | A1 | 6/2019 | Hrupp | |
| 2019/0218873 | A1 * | 7/2019 | Davis | E21B 23/01 |
| 2020/0040680 | A1 * | 2/2020 | Mhaskar | E21B 33/1208 |
| 2020/0141207 | A1 * | 5/2020 | Smith | E21B 23/01 |
| 2020/0308921 | A1 | 10/2020 | Hrupp | |
| 2021/0238951 | A1 * | 8/2021 | Rochen | E21B 33/1293 |

* cited by examiner

DOWNHOLE TOOLS AND METHODS, AND IMPROVED SLIP ASSEMBLIES AND PROFILED SLIP ELEMENTS THEREFOR

FIELD OF THE INVENTION

The present invention relates to slip elements and slip assemblies, and to downhole tools and methods in which slip elements and slip assemblies are used.

BACKGROUND OF THE INVENTION

In oil and/or gas wells, various types of downhole tool assemblies are used which commonly comprise (i) a lower slip assembly, (ii) an upper slip assembly, and (iii) one or more packing elements positioned between the opposing upper and lower slips. Examples of such downhole tool assemblies include, but are not limited to, (a) double grip packers, (b) packers installed on the lower ends of hold down tools, and (c) a bridge plugs.

When setting the downhole tool assembly in a well, the opposing upper and lower slips are activated to bite the inner wall of the well casing and the packing element(s) is/are compressed to pack the element(s) off against the I.D. (inner wall) of the casing. The compression of the packing element (s) into engagement with the casing seals the surrounding gap between the exterior of the tool assembly and the casing I.D. After the packing element(s) is/are set, the slips remain in engagement with the casing in order to (i) hold the packing element(s) in compression and (ii) prevent the tool assembly from moving in the casing.

Unfortunately, when using a double grip packer or other a tool assembly comprising one or more packing elements positioned between upper and lower slips, the pressure in the well beneath the packing element(s) can produce a sufficient amount of stored energy in the compressed packing element (s) so as to (i) make it essentially impossible to release the upper slips and remove the tool from the well or (ii) at least cause significant damage to the I.D. of the well casing.

An example of an upper slip assembly 1 of the type heretofore used in double grip tool assemblies is illustrated in FIG. 1. The prior art slip assembly 1 comprises (a) a plurality of upper slips 3 which are retained in an upper slip housing 5 and (b) an upper cone 7 which is received under the upper slips 3 to urge the upper slips 3 outwardly into engagement with the I.D. of the well casing 13. Each slip 3 comprises a plurality of cylindrical carbide inserts 9 which are held in the outer face 11 of the slip 3 for contacting and gripping/biting the I.D. of the casing.

Each of the cylindrical carbide inserts 9 has a flat, circular upper surface and is inserted into a bore which is drilled into the face 11 of the slip 3. The bore is typically drilled into the face 11 of the slip 3 at a downward/forward angle 17 of 15° or 20° such that, as the tool travels into the well in the forward/downward direction of travel 21, the upper surface of the carbide insert 9 is oriented at a large swept back (obtuse) angle 19 which is 165° or 160° away from the direction of travel 21. In other words, the swept back angle 19 is so large that the upper surface of the insert 9 is only 15° or 20° short of lying completely flat. Consequently, as the tool is run into the well, the substantially flat, swept back inclination of the upper surface of the insert 9 minimizes the frictional resistance which occurs between the carbide insert 9 and the I.D. of the well casing.

However, this angled orientation of the cylindrical insert 9 also creates a steep ridge 25 on the opposite upper/rearward side of the cylindrical carbide insert 9 which bites into the I.D. of the well casing when the upper cone 7 is received beneath the slips 3. The steep upper/rearward ridge 25 prevents the tool assembly from moving in the upward/reverse direction 27 out of the well when the slips 3 are set.

The angle 29 of the steep upper/rearward ridge 25 of the insert 9 is typically 105° or 110° away from the reverse direction of travel 27. Consequently, although the upper/rearward ridge 25 of the insert 9 is swept back from the reverse direction of travel 27 to some degree in order to assist in releasing the slip 3 and pulling the tool assembly from the well, the steep upper/rearward ridge 25 of the insert 9 is a full 75° or 70° from lying flat.

Unfortunately, although the steep upper/rearward ridge 25 of the carbide insert 9 is highly effective for gripping the well casing during use, the upward pulling force required to release the upper slips 3, even at moderate well pressures, can be enough to destroy the tool assembly and/or rip a significant amount of metal out of the I.D. of the casing.

In one prior attempt to address this problem, one or more, typically at least two, of the gripping slips 3 of the upper slip assembly 1 have been replaced with releasing slips 31 having smooth, low friction outer contacting surfaces 33. In theory, when pulled upwardly, the releasing slips 31 are intended to move upwardly more easily than the remaining slips 3 such that the tool will be permitted to move laterally to some degree, thereby allowing the cylindrical carbide inserts 9 of the remaining slips 3 to release from the I.D. of the casing.

In another prior attempt to facilitate the release of the upper slips 3, the angle 17 of the bores 15 provided in the faces 11 of the gripping slips 3 for holding the carbide inserts 9 has been increased to 45°. This increase in the angle 17 of the bores 15 for the inserts 9 decreases the severity of the angle 29 of the biting ridges 25 on the upper/rearward sides of the carbide inserts 9 so that, whereas the reverse swept back angle 29 of the biting ridges 25 of the inserts 9 was previously 105° or 110°, the reverse swept back angle 29 of the biting ridges 25 is increased to a less severe angle of 135° away from the reverse/upward direction of travel 27 out of the well. This less severe angle 29 of the gripping ridges 25 on the upper/rearward sides of inserts 9, while still sufficient for gripping the I.D. of the well casing, reduces the pulling force which is subsequently required to release the upper slips 3.

However, although the use of a 45° bore angle 17 for the carbide inserts 9 desirably reduces the severity of the slope of the gripping ridges 25 on the upper/rearward sides of inserts 9 to facilitate the release of the slips 3, the use of a 45° bore angle 17 for the carbide inserts 9 unfortunately also increases the severity of the swept back angle 19 of the upper surface of the carbide insert 9 for insertion into the well. In fact, when a 45° bore angle 17 is used for the carbide inerts 9, the swept back insertion angle 19 of the upper surfaces of the carbide inserts 9 is the same as the reverse swept back biting angle 29 of the gripping ridges 25 on the upper/rearward sides of the inserts 9 (i.e., the forward insertion angle 19 and the reverse biting angel 29 are each 135° away from the direction of travel 21 or the reverse direction of travel 27).

This increased steepness of the slope 19 of the upper surfaces of the carbide inserts 9 produces significant difficulties. Because of the increased steepness of the upper surfaces of the carbide inserts 9, the carbide inserts 9 (*i*) resist the insertion of the tool assembly into the well by attempting to bite the I.D. of the casing and by creating a significantly greater degree of frictional interference, (ii)

resist the downward movement of the upper slips 3 during setting, and (iii) require that the lower slips move upwardly when setting the packer.

Moreover, in addition to the other shortcomings and difficulties discussed above, drilling the bores 15 for the carbide inserts 9 into the faces 11 of the slips 3 at an angle requires special equipment and is more difficult. Further, when installed and used in this manner, the carbide inserts 9 tend to be easily damaged when setting the tool assembly and when pulling the tool assembly loose.

SUMMARY OF THE INVENTION

The present invention provides a slip, a profiled slip insert, and an upper slip assembly for a downhole tool which satisfy the needs and alleviate the problems mentioned above. The inventive slip, contacting insert, and upper slip assembly (i) allow the downhole tool to be run into the well with minimal biting or frictional resistance, (ii) greatly reduce the pulling force required for releasing the upper slips, (iii) do not impede the downward movement of the upper slips during setting, (iv) do not require that the lower slips move upward during setting, and (v) eliminate the need to drill the bores for the slip inserts at an angle using special equipment.

In one aspect, there is provided a slip insert for contacting a well casing. The slip insert preferably comprises: (a) a cylindrical body having a longitudinal axis and an outer end and (b) an outer gripping profile on the outer end of the cylindrical body. The outer gripping profile preferably comprises: (i) an outer gripping ridge which is spaced longitudinally outward from a lateral plane at the outer end of the cylindrical body, the lateral plane being perpendicular to the longitudinal axis; (ii) a rearwardly sloped, forwardly facing surface which extends rearwardly and outwardly to the outer gripping ridge at a swept back angle in a range of from about 155° to about 170° with respect to the lateral plane; and (iii) a forwardly sloped, rearwardly facing surface which extends forwardly and outwardly to the outer gripping ridge at a reverse swept back angle in a range of from about 135° to about 155° with respect to the lateral plane.

In another aspect, there is provided a slip insert for contacting a well casing that preferably comprises (a) a cylindrical body having a longitudinal axis and an outer end and (b) an outer gripping profile on the outer end of the cylindrical body. The outer gripping profile preferably comprises (i) a rearward surface which lies in or is substantially parallel to a first lateral plane, at the outer end of the cylindrical body, that is perpendicular to the longitudinal axis, (ii) an outer gripping ridge which is spaced longitudinally outward from the lateral plane, (iii) a forward edge in a second lateral plane that is perpendicular to the longitudinal axis, the outer gripping ridge being spaced longitudinally outward from the second lateral plane and the second lateral plane being the same as or parallel to the first lateral plane, (iv) a rearwardly sloped, forwardly facing surface which extends rearwardly and outwardly from the forward edge of the outer gripping profile to the outer gripping ridge at a swept back angle in a range of from about 155° to about 170° with respect to the first lateral plane, and (v) a forwardly sloped, rearwardly facing surface which extends forwardly and outwardly from the rearward surface to the outer gripping ridge at a reverse swept back angle in a range of from about 135° to about 155° with respect to the first lateral plane.

In another aspect, there is provided a slip for engaging a well casing. The slip preferably comprises: (a) an outer face; (b) a plurality of bores provided in the outer face; and (c) each of the bores having a contacting insert therein. The contacting insert preferably comprises (i) a cylindrical body which is received in the bore, the cylindrical body having a longitudinal axis and an outer end, and (ii) an outer gripping profile on the outer end of the cylindrical body which projects outwardly from the bore. The outer gripping profile comprises: (a) an outer gripping ridge which is spaced longitudinally outward from a lateral plane at the outer end of the cylindrical body, the lateral plane being perpendicular to the longitudinal axis, (b) a rearwardly sloped, forwardly facing surface which extends rearwardly and outwardly to the outer gripping ridge at a swept back angle in a range of from about 155° to about 170° with respect to the lateral plane, and (c) a forwardly sloped, rearwardly facing surface which extends forwardly and outwardly to the outer gripping ridge at a reverse swept back angle in a range of from about 135° to about 155° with respect to the lateral plane.

In another aspect, there is provided a slip assembly for a downhole tool. The slip assembly comprises a plurality of gripping slips held in the slip assembly wherein each of the gripping slips preferably comprises: (a) an outer face; (b) a plurality of bores provided in the outer face; and (c) each of the bores having a contacting insert therein comprising (i) a cylindrical body which is received in the bore, the cylindrical body having a longitudinal axis and an outer end, and (ii) an outer gripping profile on the outer end of the cylindrical body which projects outwardly from the bore. The outer gripping profile comprises (a) an outer gripping ridge which is spaced longitudinally outward from a lateral plane at the outer end of the cylindrical body, the lateral plane being perpendicular to the longitudinal axis, (b) a rearwardly sloped, forwardly facing surface which extends rearwardly and outwardly to the outer gripping ridge at a swept back angle in a range of from about 155° to about 170° with respect to the lateral plane, and (c) a forwardly sloped, rearwardly facing surface which extends forwardly and outwardly to the outer gripping ridge at a reverse swept back angle in a range of from about 135° to about 155° with respect to the lateral plane.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 2:
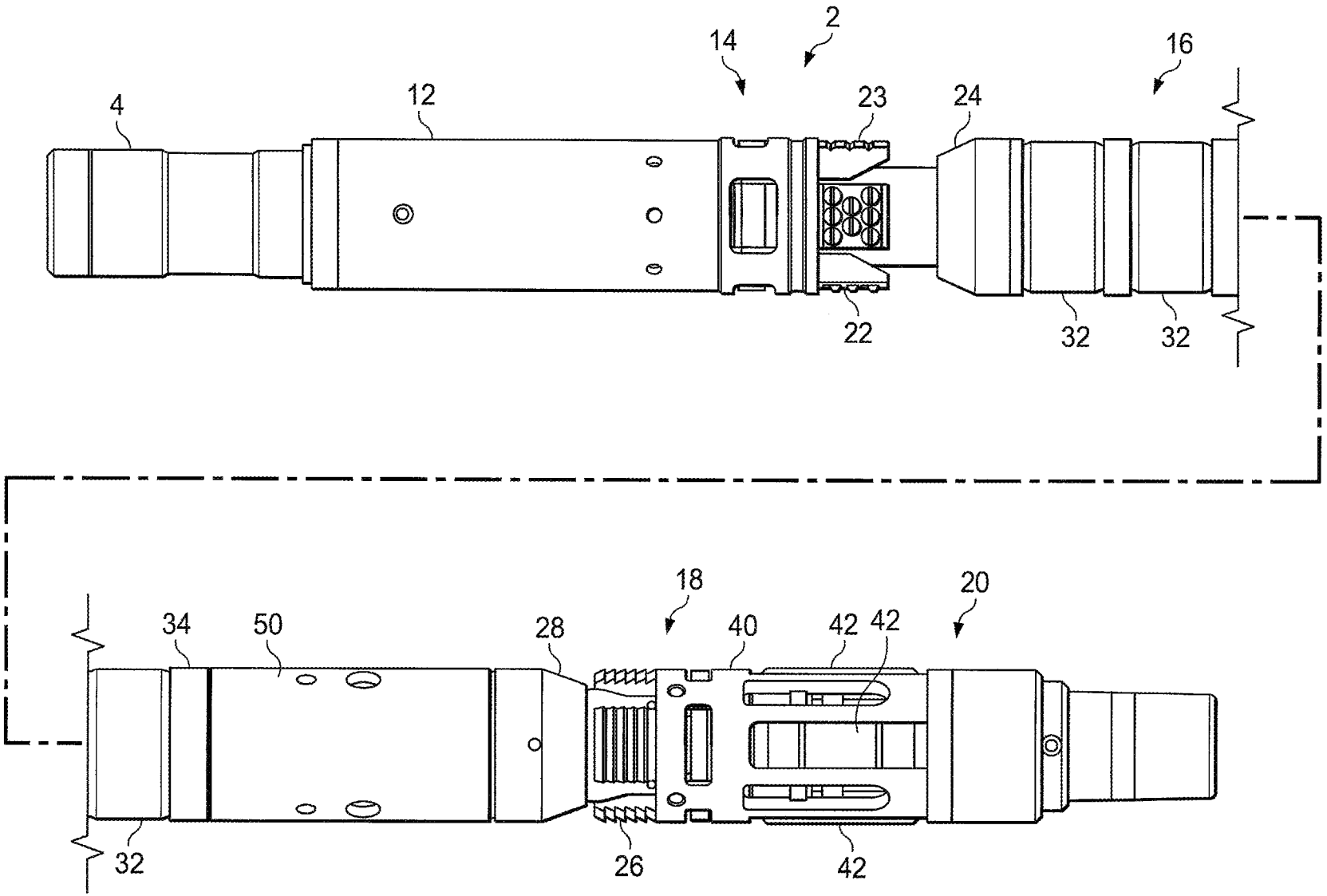
FIG. 2 is a side view of an embodiment 2 of a double grip downhole tool assembly provided by the present invention.
Figure 3:
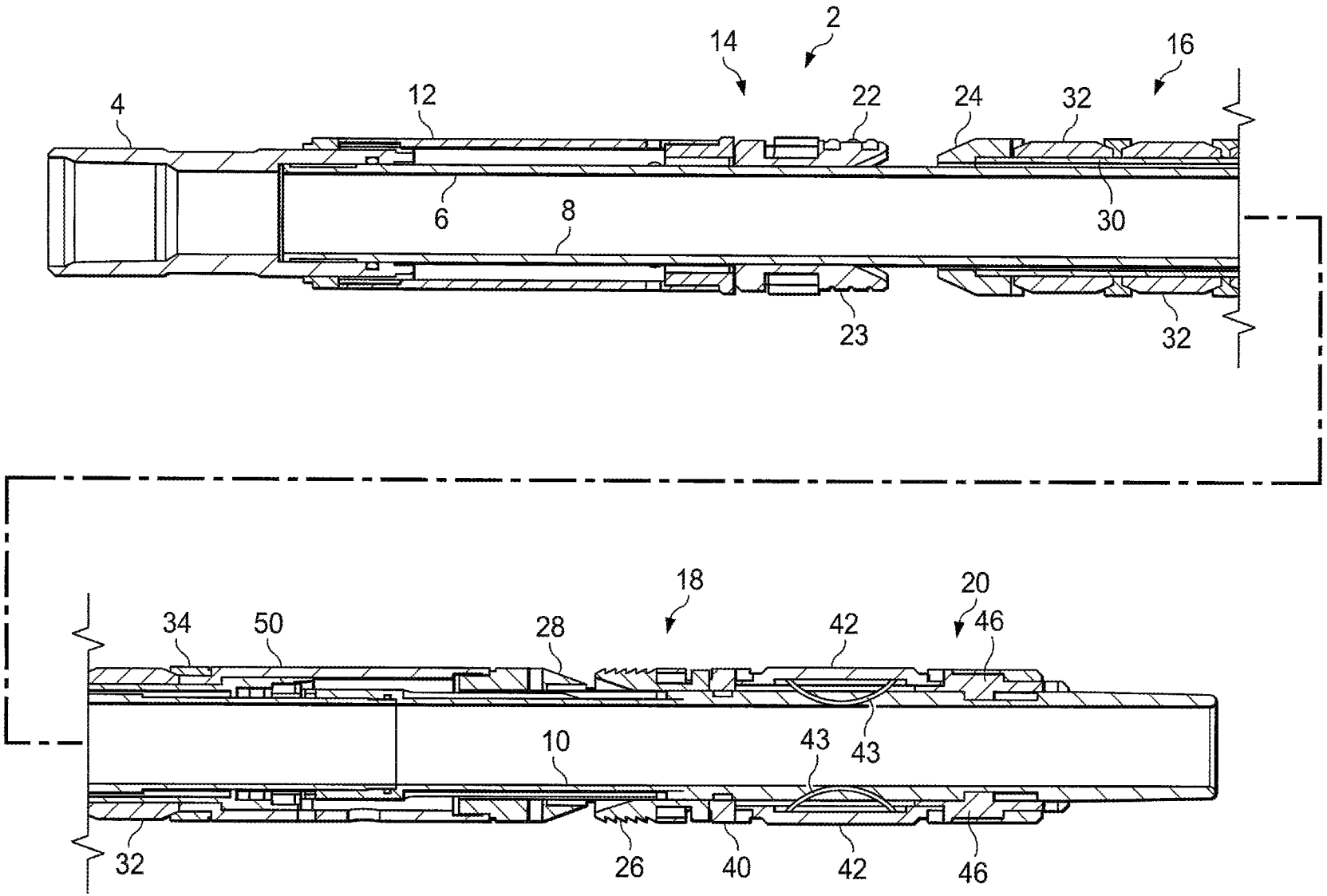
FIG. 3 is a cutaway side view of the inventive double grip downhole tool assembly 2.
Figure 4:
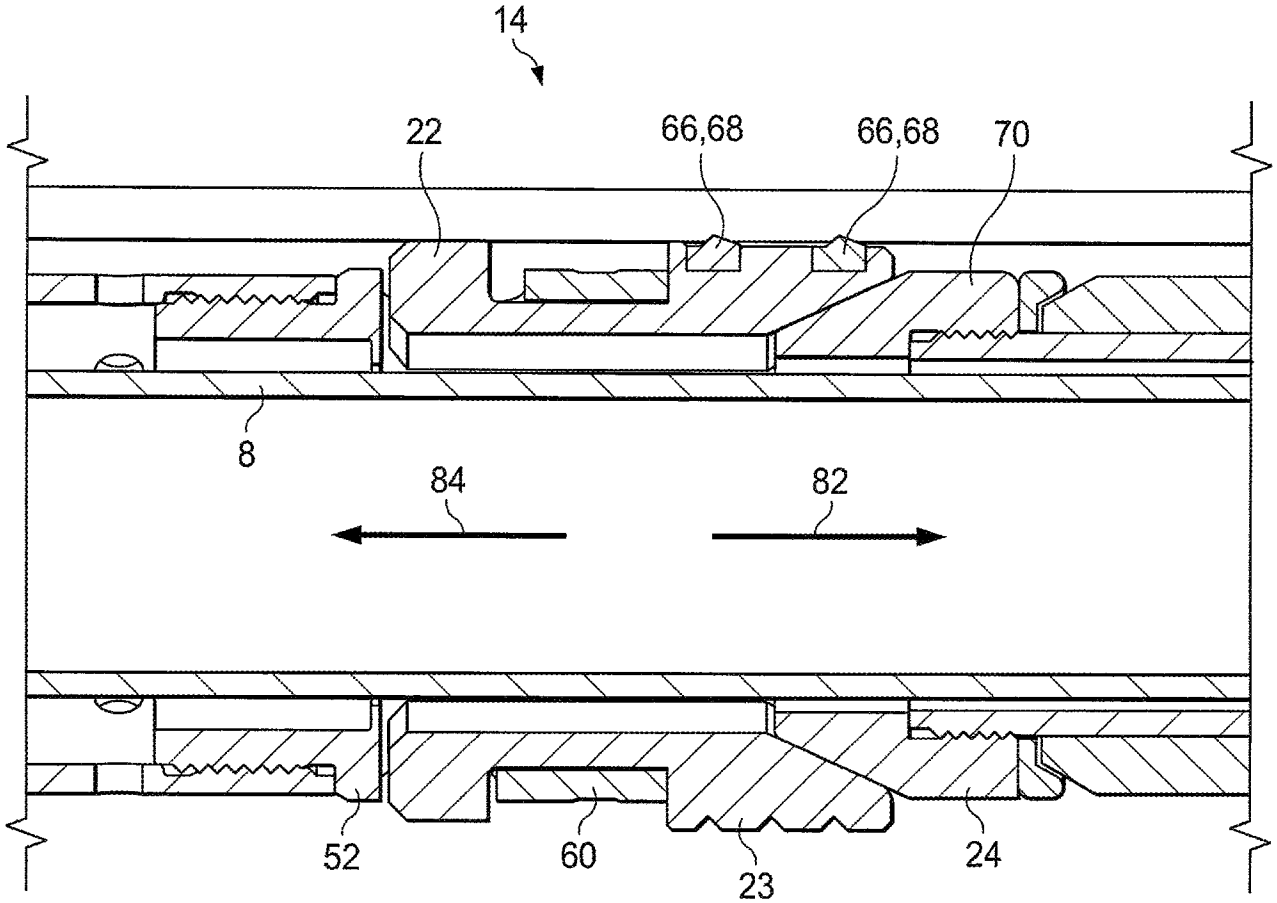
FIG. 4 is a cutaway side view of an embodiment 14 of an inventive upper slip assembly used in the downhole tool assembly 2.
Figure 5:
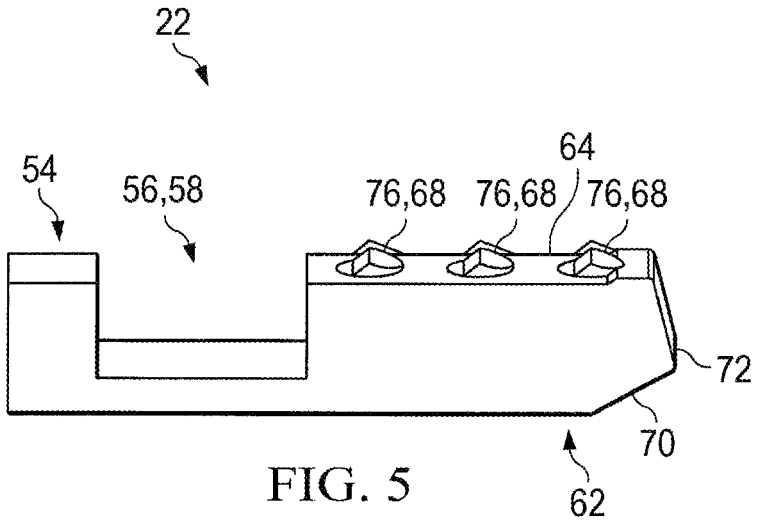
FIG. 5 is a side view of an embodiment 22 of an inventive slip used in the inventive upper slip assembly 14.
Figure 6:
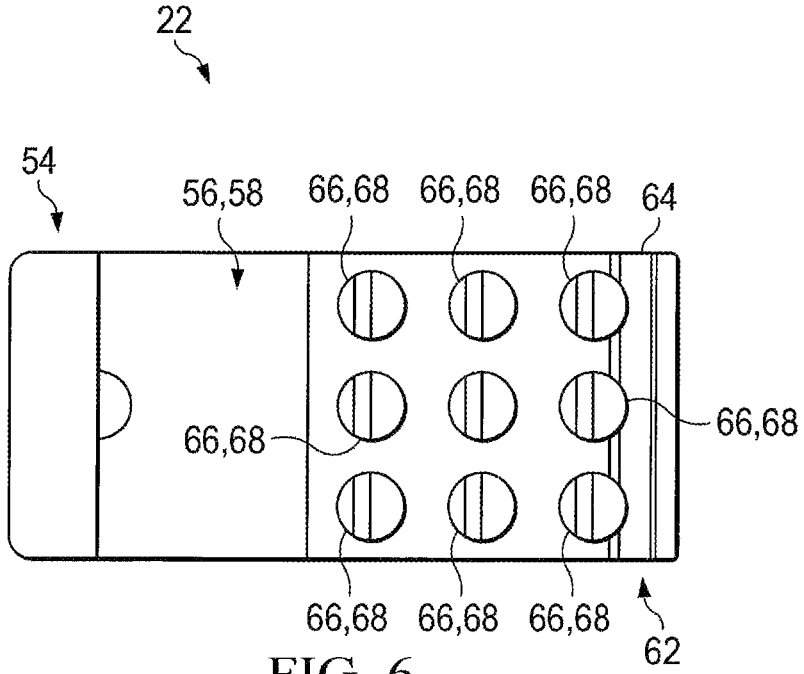
FIG. 6 is a top view of the inventive slip 22.
Figure 7:
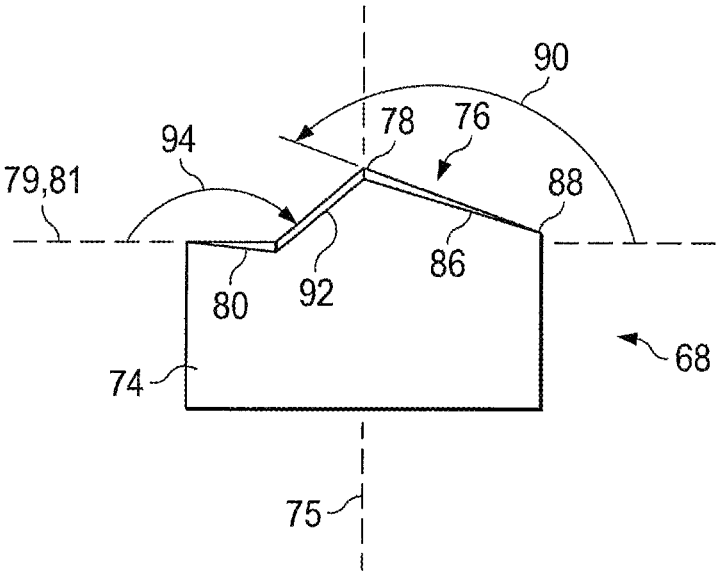
FIG. 7 is an elevational side view of an embodiment 68 of an inventive profiled contacting insert used in the slip 22.
Figure 8:
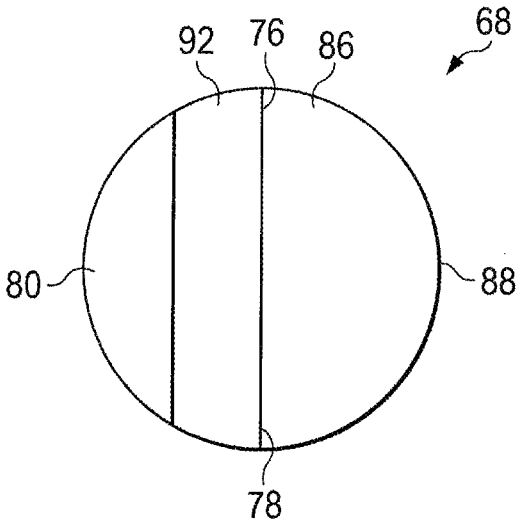
FIG. 8 is a top view of the inventive profiled contacting insert 68.

An embodiment 2 of the double grip downhole tool assembly (e.g., a double grip packing apparatus with opposing slips) provided by the present invention is illustrated in FIGS. 2 and 3. The inventive double grip tool assembly 2 comprises a top sub 4 and a mandrel string 6 which extends downwardly from the top sub 4. The mandrel string 6 comprises an inner mandrel 8, and a J-slot mandrel 10 which extends downwardly from the lower end of the inner mandrel 8. The mandrel string 6 extends downwardly through: (i) a spring cage 12; (ii) an inventive upper slip assembly 14; (iii) a packing element assembly 16; (iv) a lower slip assembly 18; and (iv) a drag block assembly 20.

The inventive double grip tool assembly 2 can be secured on the end of a tubing string for running the downhole tool 2 into a well and mechanically setting the tool 2 by compression and/or tension setting. Alternatively, the inventive tool assembly 2 can be run into the well on a wireline and set in the well at a desired location using, e.g., a Baker #20 setting tool or other wireline device.

As used herein and in the claims, terms such as up and down, top and bottom, above and below, upward and downward, upwardly and downwardly, and upper and lower merely refer to the orientation of the inventive double grip tool assembly 2 when positioned in a vertical portion of the well. Consequently, if, for example, the inventive tool assembly 2 is located in a horizontal portion of the well, the lower or bottom end of the tool 2 would simply be the end of the tool 2 which is furthest downhole.

The term "about", when used herein and in the claims in reference to a length or angle or distance or pressure, means±5%. The term "substantially perpendicular" when used herein and in the claims means perpendicular or not more than 10° from perpendicular. The term "substantially parallel" when used herein and in the claims means parallel or not more than 10° from parallel.

The inventive upper slip assembly 14 used in the inventive double grip tool assembly 2 comprises (i) a plurality of inventive gripping slips 22, (ii) the optional use of one or more releasing slips 23, and (iii) an upwardly facing upper cone 24 which is received under the gripping slips 22 (as well as under the releasing slips 23 if present) to urge the upper slips 22 and 23 outwardly into engagement with the I.D. of the well casing. Similarly, the lower slip assembly 18 comprises a plurality of lower slips 26 and a downwardly facing lower cone structure or cone assembly 28 having a cone which is received under the lower slips 26 to urge the lower slips 26 outwardly into engagement with the I.D. of the casing.

Although not included in the embodiment of the inventive tool assembly 2 shown in FIGS. 2 and 3, it will be understood that the inventive gripping slips 22 can also be used in the lower slip assembly 18. Moreover, it will additionally be understood that the inventive slip assembly 14, the inventive slips 22, and the inventive contacting inserts 68 can be used in downhole tools other than those expressly mentioned herein.

The packing element assembly 16 comprises: a packer support sleeve 30 through which the inner mandrel 8 extends; packing elements 32 which are positioned around the packer support sleeve 30; and a lower gage ring 34 which is positioned around the packer support sleeve 30 beneath, and against the bottom end of, the packing elements 32. The upper end of the packer support sleeve 30 is received in and holds the upper cone 24.

Examples of materials suitable for forming the packing elements 32 include, but are not limited to, Hydrogenated Nitrile Butadiene Rubber (HNBR) such as Ecner HNBR, or Ecner Aflas™.

The drag block assembly 20 comprises: a drag block body 40; a plurality of drag blocks 42 which are retained in the body 40; a plurality of drag block springs 43 positioned in the body 40 beneath the drag blocks 42 for continuously urging the drag blocks 42 outwardly into contact with the inner wall of the well casing; and a plurality of J-slot pins 46 which extend radially inward and are received in the mandrel J-slots formed in the exterior of the J-slot mandrel 10.

The frictional contact between the drag blocks 42 and the I.D. of the well casing provides an amount of resistance which is sufficient to prevent the drag block assembly 20, and the J-slot pins 46 thereof, from rotating or moving when the mandrel string 6 is selectively lifted, rotated, and/or lowered within the drag block body 40 for purposes of repositioning the J-slot pins 46 in the mandrel J-slots. This allows the J-slot pins 46 to be selectively repositioned (i) against run-in shoulders within the mandrel J-slots to prevent the engagement of the slips 22, 23, and 26 when running the inventive double grip tool assembly 2 into the well or (ii) in longitudinally extending linear portions of the mandrel J-slots for compression setting the tool 2 or (iii) against tension shoulders within the mandrel J-slots for tension setting the tool 2 or (iv) against retrieval shoulders within the mandrel J-slots for retrieving the tool 2 from the well.

The inventive double grip tool assembly 2 further comprises a packing element retaining sleeve 50 having an upper end which engages the gage ring 34 of the packing element assembly 16.

When set in a well, the upper and lower slips 22, 23, and 26 are forced outwardly by the upper and lower cones 24 and 28 and the packing element 32 is compressed such that the packing element 32 is packed-off against the I.D. of the well casing. In this set configuration, the upper and lower slips 22, 23, and 26 grip the inner surface of the casing to hold the packing element 32 in compression and prevent the packer 2 from moving upwardly or downwardly in the well.

When releasing the inventive double grip tool assembly 2 and retrieving the tool assembly 2 from the well, the J-slot pins 46 of the drag block assembly 20 will typically first be repositioned such that the J-slot pins 46 are located in linear retrieval segments of the mandrel J-slots. By way of example, but not by way of limitation, the mandrel J-slots can be configured such that, in order to reposition the J-slot pins 46 in the linear retrieval segments of the mandrel J-slots, the mandrel string 6 is set downwardly within the tool assembly 2 and then rotated, e.g., a quarter of a turn to the right.

The inventive upper slip assembly 14 and the inventive gripping slips 22 are illustrated in greater detail in FIGS. 4-8. The upper slip assembly 14 comprises (i) an upper slip housing 52 through which the inner mandrel 8 extends and (ii) a plurality of the inventive gripping slips 22 which are retained in the housing 52. As also mentioned above, in addition to using a plurality of the inventive gripping slips 22, the upper slip assembly 14 can optionally also include one or more releasing slips 23 which, for example, can be the same as or similar to the releasing slips 31 shown in FIG. 1.

Each of the inventive gripping slips 22 preferably comprises: (i) an upper end portion 54 having a lateral slot 56 formed across the outer side 58 thereof which receives a lower collar 60 of the upper slip housing 52 for loosely retaining the slip 22 in the slip housing 52; (ii) a lower portion 62 of the slip 22 which has an outer face 64; (iii) a plurality of bores 66 which are drilled into or otherwise formed in the outer face 64, the bores 66 being perpendicular to (i.e., non-angled with respect to) the outer face 64 of the lower portion 62 of the inventive slip 22; (iv) a corresponding number of inventive profiled contacting inserts 68 which are received in the bores 66; and (iv) an angled lower inside surface 70 which extends upwardly at a converging angle from the bottom end 72 of the inventive slip 22 for receiving the upper cone 24 of the upper slip assembly 14.

The inventive contacting inserts 68 used in the inventive slips 22 will preferably be carbide inserts but can alternatively be formed of other materials having sufficient strength, durability, and resistance. The inventive contacting inserts 68 have (i) cylindrical bodies 74 which are received in the bores 66 of the slips 22 and (ii) outer gripping profiles 76, on the outer ends of the cylindrical bodies 74, which project outwardly from the bores 66 for contacting and biting the I.D. of the well casing. The cylindrical body 74 of each of the contacting inserts 68 has a longitudinal axis 75.

The outer gripping profile 76 of each of the inventive contacting inserts 68 preferably comprises: (a) an outer gripping ridge 78; (b) a flat rearward surface 80 which lies in or is substantially parallel to a lateral plane 79, at the outer end of the cylindrical body 74, that is perpendicular to the longitudinal axis 75 (and the flat rearward surface 80 therefore also being substantially parallel to the forward and rearward directions of travel 82 and 84 of the inventive tool assembly 2 into and out of the well); (c) the outer gripping ridge 78 being spaced longitudinally outward from the lateral plane 79; (d) a forward edge 88 of the upper gripping profile 76 which lies in a second lateral plane 81 that is perpendicular to the longitudinal axis 75; (e) the outer gripping ridge 78 being spaced longitudinally outward from the second lateral plane 81; (f) the second lateral plane 81 being the same as or parallel to the first lateral plane 79; (g) a rearwardly sloped, forwardly facing surface 86 which extends rearwardly and outwardly from the forward edge 88 of the upper gripping profile 76 to the upper gripping ridge 78 at a swept back angle 90 away from and with respect to the first lateral plane 79 (and therefore also with respect to the forward direction of travel 82); and (h) a forwardly sloped, rearwardly facing surface 92 which extends forwardly and outwardly from the flat rearward surface 80 to the upper gripping ridge 78 at a reverse swept back angle 94 away from and with respect to the first lateral plane 79 (and therefore also with respect to the rearward direction of travel 84).

The swept back angle 90 of the rearwardly sloped, forwardly facing surface 86 of the upper gripping profile 76 of the inventive insert 68 is preferably in the range of from about 155° to about 170° with respect to and away from the first lateral plane 79. The swept back angle 90 of the forwardly facing surface 86 of the upper gripping profile 76 is more preferably in the range of from about 158° to about 165° and is more preferably about 160°.

The reverse swept back angle 94 of the forwardly sloped, rearwardly facing surface 92 of the upper gripping profile 76, on the other hand, is preferably in the range of from about 135° to about 155° with respect to and away from the first lateral plane 79. The reverse swept back angle 94 of the rearwardly facing surface 92 of the upper gripping profile 76 is more preferably in the range of from about 138° to about 142° and is more preferably about 140°.

Figure 1:
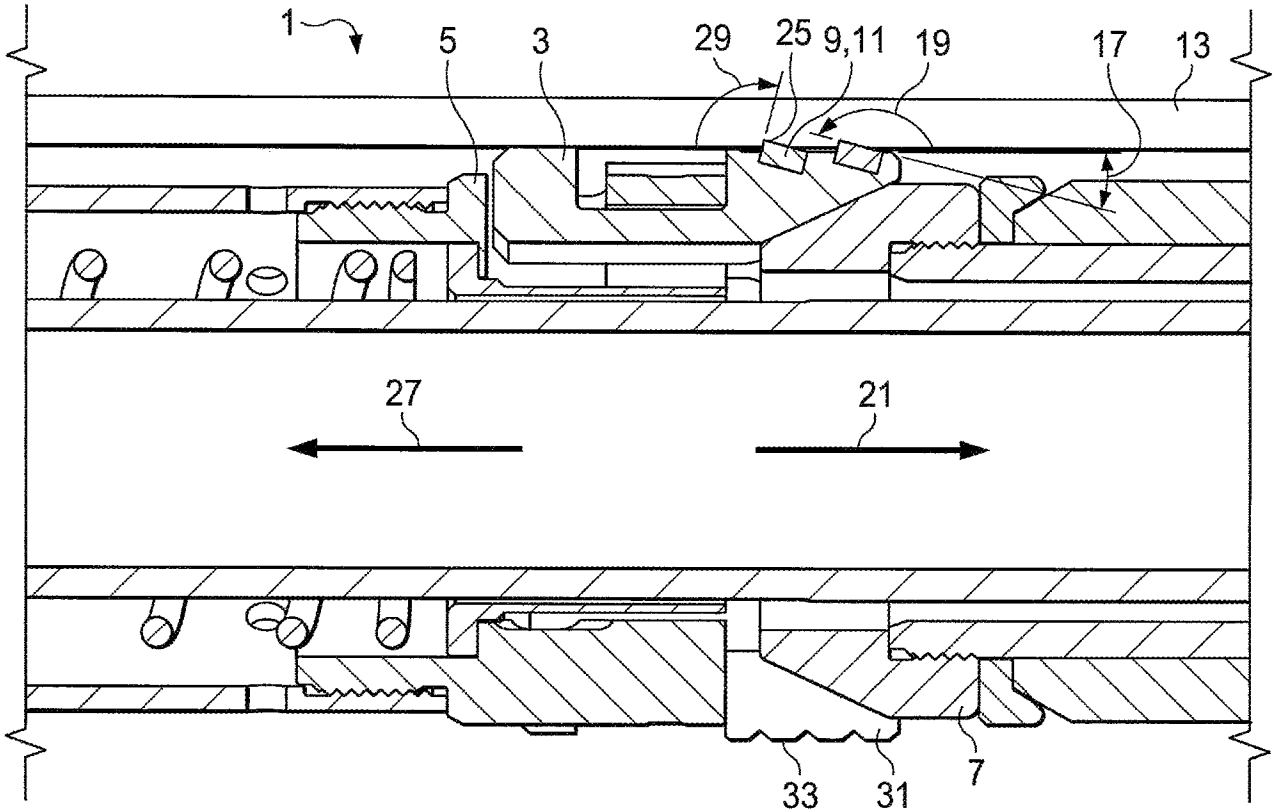
FIG. 1 (PRIOR ART)
FIG. 1 is a cutaway side view of a prior art upper slip assembly 1.

Consequently, the swept back angle 90 of the sloped forwardly facing surface 86 of the upper gripping profile 76 of the inventive contacting insert 68 is comparable to the swept back angle 19 of the upper surface of the prior art carbide insert 9, shown in FIG. 1, wherein the bore for the prior art carbide insert 9 is drilled into the outer face 11 of the prior art slip 3 at downward/forward angle 17 of from 15° to 20°. In other words, the swept back (obtuse) angle 90 of the sloped forwardly facing surface 86 of the upper gripping profile 76 of the inventive contacting insert 68 is so large that the forwardly facing surface 86 of the inventive insert 68 is only from about 10° to about 25° short (most preferably only about 20° short) of lying completely flat. Therefore, as the inventive double grip tool 2 is run into the well, the substantially flat, swept back inclination of the forwardly facing surface 86 of the upper gripping profile 76 of the inventive contacting insert 68 minimizes the frictional resistance which occurs between the inventive insert 68 and the I.D. of the well casing.

However, in contrast to the prior art slip assembly 1 shown in FIG. 1 wherein the bores for the prior art carbide inserts 9 are drilled at a downward/forward angle 17 of from 15° to 20°, the reverse swept back angle 94 of the forwardly sloped, rearwardly facing surface 92 of the upper gripping profile 76 of the inventive contacting insert 68 is much less severe than the steep angle 29 of the upper/rearward ridge 25 of the prior art insert 9. In fact, the reverse swept back (obtuse) angle 94 of the rearwardly facing surface 92 of the upper gripping profile 76 of the inventive contacting insert 68 is more comparable to the much less severe angle 29 of the upper/rearward ridge 25 of the prior art insert 9 when the bores for the prior art inserts 9 are instead drilled at a downward/forward angle 17 of 45°.

This less severe angle 94 of the rearwardly facing surface 92 of the upper gripping profile 76 of the inventive contacting insert 68, while still sufficient for firmly gripping the I.D. of the well casing, reduces the pulling force which is subsequently required to release the inventive upper slips 22.

In addition to the other benefits and advantages discussed above, there is also no need to drill the bores 66 for the inventive contacting inserts 68 into the inventive slips 22 at an angle using special equipment. Moreover, when installed in accordance with the present invention, the inventive contacting inserts 68 are not easily damaged when setting the inventive tool assembly 2 or when pulling the inventive tool assembly 2 loose.

EXAMPLES

In each of the following examples, an inventive double grip packer 2 as illustrated in FIGS. 2-8 was compared to a prior art double grip packer. The prior art double grip packer was identical to the inventive double grip packer 2 except that (i) the upper slips used in the prior art packer were prior art slips 3 as illustrated in FIG. 1 and (ii) the bores for the cylindrical carbide inserts 9 of the prior art slips 3 were drilled at a downward/rearward angle 17 of 15°. In the inventive double grip packer 2, the swept back angle 90 of the rearwardly sloped, forwardly facing surface 86 of the upper gripping profile 76 of each of the inventive contacting inserts 68 was 160° and the reverse swept back angle 94 of the sloped, rearwardly facing surface 92 was 140°.

Example 1

The inventive double grip packer 2 and the prior art packer were each tested in bull plugged condition with an applied pressure of 2000 psi below the packer. A straight pulling force of 8,000 pounds was required to pull the upper slips of the prior art packer free but a straight pulling force of only 5,080 pounds was required for the inventive double grip packer 2.

Example 2

The inventive double grip packer 2 and the prior art packer were each tested in bull plugged condition with an applied pressure of 4000 psi below the packer. A straight pulling force of 30,480 pounds was required to pull the upper slips of the prior art packer free but a straight pulling force of only 10,000 pounds was required for the inventive double grip packer 2.

Example 3

The inventive double grip packer 2 and the prior art packer were each tested in bull plugged condition with an applied pressure of 6000 psi below the packer. A straight pulling force of 65,000 pounds was required to pull the upper slips of the prior art packer free but a straight pulling force of only 16,000 pounds was required for the inventive double grip packer 2.

Example 4

The inventive double grip packer 2 and the prior art packer were each tested in bull plugged condition with an applied pressure of 8000 psi below the packer. The prior art slips could not be pulled loose without being destroyed. But a straight pulling force of 45,000 pounds was able to pull the upper slips 22 of the inventive double grip packer 2 free.

Thus, the present invention is well adapted to carry out the objectives and attain the ends and advantages mentioned above as well as those inherent therein. While presently preferred embodiments have been described for purposes of this disclosure, numerous changes and modifications will be apparent to those in the art. Such changes and modifications are encompassed within the invention as defined by the claims.

What is claimed is:

1. A double grip downhole tool assembly for use in a well casing, the double grip downhole tool assembly comprising an upper slip assembly, a lower slip assembly, and a packing element assembly positioned between the upper slip assembly and the lower slip assembly, the upper slip assembly comprising a plurality of gripping slips held in the upper slip assembly that each comprise:

an outer face;

a plurality of bores provided in the outer face; and each of the bores having a contacting insert therein comprising a cylindrical body which is received in the bore, the cylindrical body having a longitudinal axis and an outer end, and an outer gripping profile on the outer end of the cylindrical body which projects outwardly from the bore, the outer gripping profile comprising an outer gripping ridge which is spaced longitudinally outward from a lateral plane at the outer end of the cylindrical body, the lateral plane being perpendicular to the longitudinal axis, a rearwardly sloped, forwardly facing surface which extends rearwardly and outwardly to the outer gripping ridge at a swept back angle in a range of from 155° to 170° with respect to a downhole direction of travel of the double grip downhole tool assembly in the well casing, and a forwardly sloped, rearwardly facing surface which extends forwardly and outwardly to the outer gripping ridge at a reverse swept back angle in a range of from 135° to 155° with respect to an uphole pulling direction of travel of the double grip downhole tool assembly in the well casing wherein, in a bull plugged condition with an applied pressure of 8000 psi below the packing element assembly, the double grip downhole tool assembly will pull free, without destroying the double grip downhole tool assembly, by applying a straight pulling force to the double grip downhole tool assembly.

2. The double grip downhole tool assembly of claim 1 further comprising the bores being perpendicular to the outer face.

3. The double grip downhole tool assembly of claim 1 further comprising the contacting insert being a carbide insert.

4. The double grip downhole tool assembly of claim 1 further comprising the swept back angle of the forwardly facing surface being in a range of from 158° to 165° and the reverse swept back angle of the rearwardly facing surface being in a range of from 138° to 142°.

5. The double grip downhole tool assembly of claim 4 further comprising the swept back angle of the forwardly facing surface being about 160°.

6. The double grip downhole tool assembly of claim 4 further comprising the reverse swept back angle of the rearwardly facing surface being about 140°.

7. The double grip downhole tool assembly of claim 1 further comprising one or more releasing slips also held in the upper slip assembly.

8. A double grip downhole tool assembly for use in a well casing, the double grip downhole tool assembly comprising an upper slip assembly, a lower slip assembly, and a packing element assembly positioned between the upper slip assembly and the lower slip assembly, the upper slip assembly comprising a plurality of gripping slips held in the upper slip assembly that each comprise:

an outer face;

a plurality of bores provided in the outer face; and each of the bores having a contacting insert therein comprising an outer gripping profile which projects outwardly from the bore, the outer gripping profile comprising an outer gripping ridge, a rearwardly sloped, forwardly facing surface which extends rearwardly and outwardly to the outer gripping ridge at a swept back angle in a range of from 155° to 170° with respect to a downhole direction of travel of the double grip downhole tool assembly in the well casing, and a forwardly sloped, rearwardly facing surface which extends forwardly and outwardly to the outer gripping ridge at a reverse swept back angle in a range of from 135° to 155° with respect to an uphole pulling direction of travel of the double grip downhole tool assembly in the well casing wherein, in a bull plugged condition with an applied pressure of 8000 psi below the packing element assembly, the double grip downhole tool assembly will pull free, without destroying the double grip downhole tool assembly, by applying a straight pulling force to the double grip downhole tool assembly.

9. The double grip downhole tool assembly of claim 8 further comprising the bores being perpendicular to the outer face.

10. The double grip downhole tool assembly of claim 8 further comprising the contacting insert being a carbide insert.

11. The double grip downhole tool assembly of claim 8 further comprising the swept back angle of the forwardly facing surface being in a range of from 158° to 165° and the reverse swept back angle of the rearwardly facing surface being in a range of from 138° to 142°.

12. The double grip downhole tool assembly of claim 11 further comprising the swept back angle of the forwardly facing surface being about 160°.

13. The double grip downhole tool assembly of claim 11 further comprising the reverse swept back angle of the rearwardly facing surface being about 140°.

14. The double grip downhole tool assembly of claim 8 further comprising one or more releasing slips also held in the upper slip assembly.

* * * * *